US012286970B2

(12) United States Patent
Kato et al.

(10) Patent No.: US 12,286,970 B2
(45) Date of Patent: Apr. 29, 2025

(54) OIL PUMP

(71) Applicant: Hitachi Astemo, Ltd., Hitachinaka (JP)

(72) Inventors: Daisuke Kato, Hitachinaka (JP); Koji Saga, Hitachinaka (JP); Nobuaki Sogawa, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 18/685,353

(22) PCT Filed: Jul. 8, 2022

(86) PCT No.: PCT/JP2022/027076
§ 371 (c)(1),
(2) Date: Feb. 21, 2024

(87) PCT Pub. No.: WO2023/042530
PCT Pub. Date: Mar. 23, 2023

(65) Prior Publication Data

US 2024/0344515 A1 Oct. 17, 2024

(30) Foreign Application Priority Data

Sep. 14, 2021 (JP) ..... 2021-149086

(51) Int. Cl.
*F04C 2/344* (2006.01)
*F01C 21/08* (2006.01)
(Continued)

(52) U.S. Cl.
CPC ..... *F04C 15/06* (2013.01); *F01C 21/0836* (2013.01); *F04C 2/3441* (2013.01); *F04C 14/226* (2013.01); *F04C 2210/206* (2013.01)

(58) Field of Classification Search
CPC ..... F04C 2/344; F04C 2/3441; F04C 2/3442; F04C 14/223; F04C 14/22; F04C 15/06;
(Continued)

(56) References Cited

U.S. PATENT DOCUMENTS

2008/0118372 A1* 5/2008 Hoshina ..... F04C 14/226 418/24
2018/0163543 A1* 6/2018 Morton ..... F04C 14/226
2020/0141407 A1 5/2020 Kato et al.

FOREIGN PATENT DOCUMENTS

JP 61-134589 U 8/1986
JP 2003-74725 A 3/2003
JP 2019-19673 A 2/2019

OTHER PUBLICATIONS

International Search Report (PCT/ISA/210) issued in PCT Application No. PCT/JP2022/027076 dated Aug. 9, 2022 with English translation (4 pages).

(Continued)

*Primary Examiner* — Theresa Trieu
(74) *Attorney, Agent, or Firm* — Crowell & Moring LLP

(57) ABSTRACT

An oil pump includes: a housing; a pump constituting section; a discharge opening portion; and a suction opening portion which includes a termination end portion including a termination end inner circumference portion, a termination end outer circumference portion provided radially outside the termination end inner circumference portion, and positioned radially outside the cam profile surface, a curved surface portion connecting the termination end inner circumference portion and the termination end outer circumference portion, and a cross portion at which the curved surface portion is crossed with the cam profile surface, and which is positioned at a position at which a radial length of a vane of the plurality of the vanes that confronts the suction opening portion is shorter than a half of an entire length of the vane.

6 Claims, 10 Drawing Sheets

(51) Int. Cl.
*F04C 14/22* (2006.01)
*F04C 15/06* (2006.01)

(58) Field of Classification Search
CPC ..... F04C 2210/206; F04C 14/226; F01C 21/0836
See application file for complete search history.

(56) References Cited

OTHER PUBLICATIONS

International Preliminary Report on Patentability (PCT/IB/326, PCT/IB/338 & PCT/IB/373) issued in PCT Application No. PCT/JP2022/027076 dated Mar. 28, 2024, including Japanese-language Written Opinion (PCT/ISA/237) with English translation (13 pages).

* cited by examiner

PRIOR ART

PRIOR ART

OIL PUMP

TECHNICAL FIELD

This invention relates to an oil pump.

BACKGROUND ART

An oil pump described, for example, in a below-described patent document 1 is known as an oil pump.

The oil pump of the patent document 1 includes a housing including a pump receiving chamber; a cam ring provided within the pump receiving chamber; a rotor received radially inside the cam ring; and a plurality of vanes provided on an outer circumference side of the rotor to be moved into and out of the rotor. Moreover, a suction opening portion is formed on a bottom surface of the pump receiving chamber. The suction opening portion is configured to supply an oil to an operation chamber provided between adjacent vanes.

PRIOR ART DOCUMENT

Patent Document

Patent Document 1: Japanese Patent Application Publication No. 2019-19673

SUMMARY OF THE INVENTION

Problems Which the Invention is Intended to Solve

In the oil pump of the patent document 1, no considerations are given on the noise generated due to the interference between an edge portion of the suction opening portion, and the vanes. Accordingly, when the vanes are fallen in the suction opening portion due to the hydraulic pressure difference between side clearances confronting between both side surfaces of the cam ring, and inner side surfaces of the housing, the vanes are caught (engaged) in the housing and the cam ring, so that the noise is generated.

It is an object of the present invention devised to solve the above described problems of the conventional device, and to suppress the noise due to the falling of the vanes into the suction opening portion.

Means for Solving the Problem

In the present invention, the termination end portion of the suction opening portion includes a termination end inner circumference portion, a termination end outer circumference portion positioned radially outside the cam profile surface, and a curved surface portion connecting the termination end inner circumference portion and the termination end outer circumference portion. At a cross portion at which the curved surface portion is crossed with the cam profile surface, a radial length of a vane of the plurality of the vanes that confronts the suction opening portion is shorter than a half of an entire length of the vane.

Benefit of the Invention

In the present invention, it is possible to suppress the noise due to the falling of the vane into the suction opening portion.

DESCRIPTION OF EMBODIMENTS

A variable displacement oil pump according to one embodiment is explained as an oil pump according to the present invention with reference to the drawings.

First Embodiment (Configuration of Variable Displacement Oil Pump)

Figure 1:
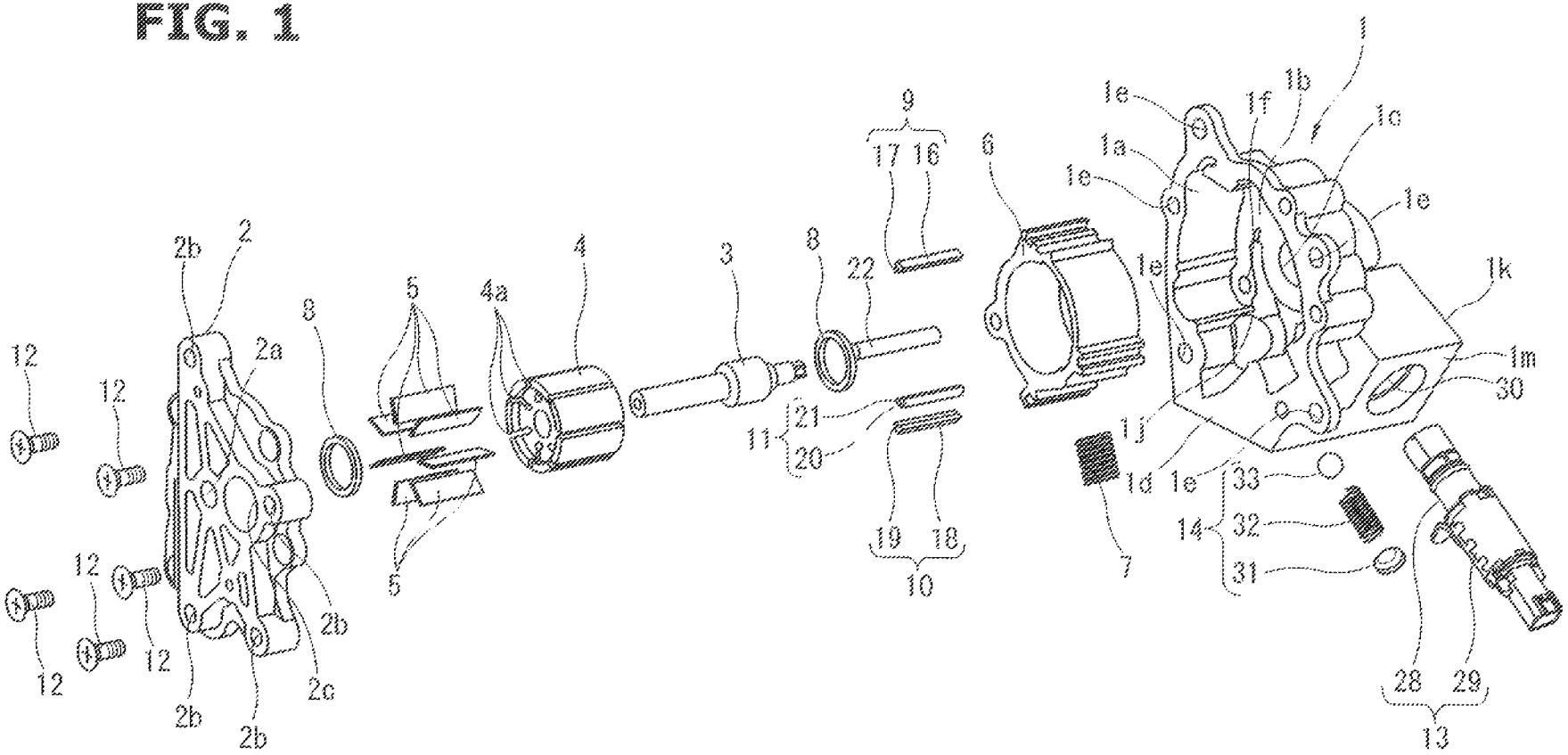
FIG. 1 is an exploded perspective view showing a variable displacement oil pump according to a first embodiment.
Figure 2:
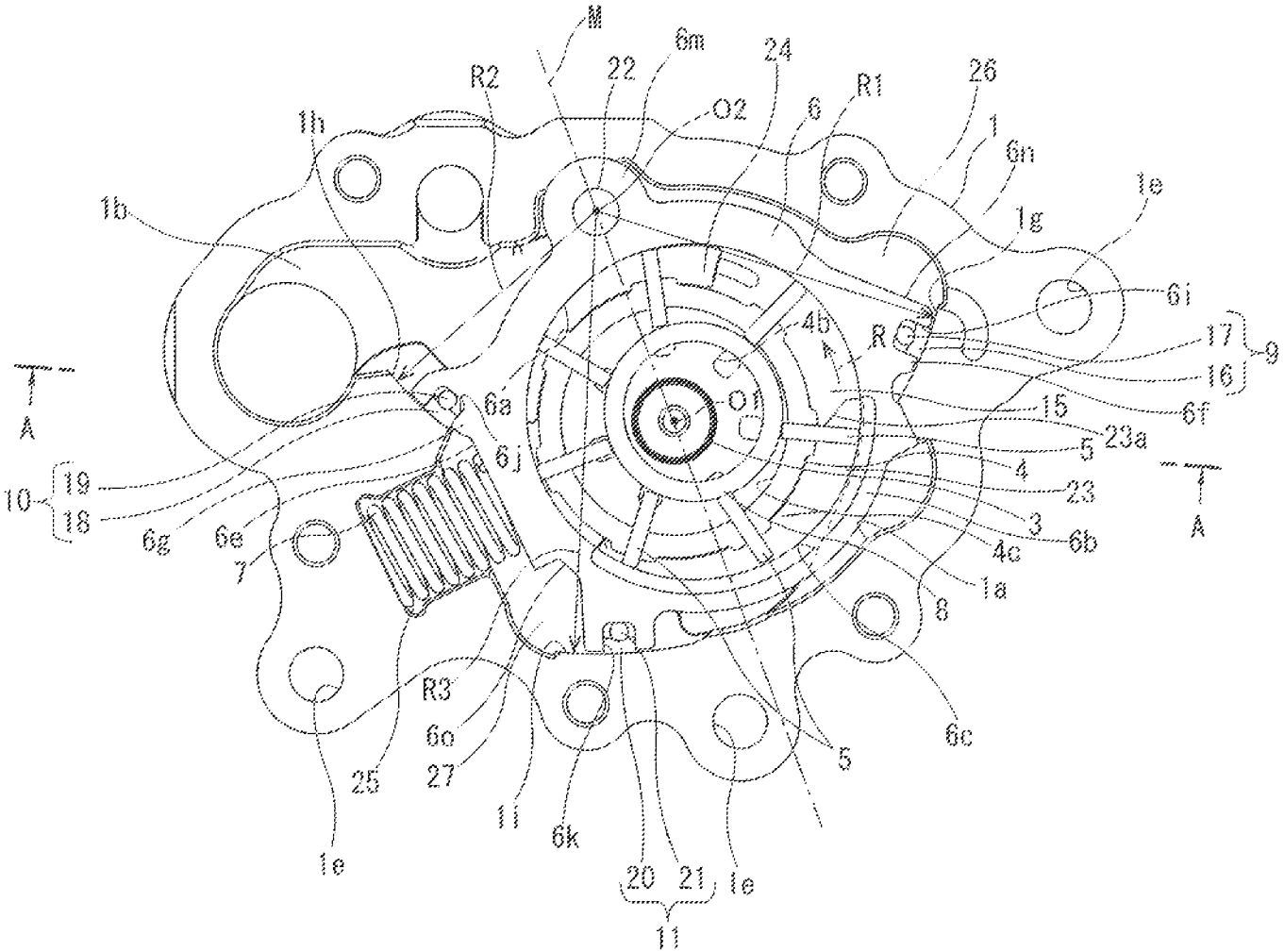
FIG. 2 is a front view showing the variable displacement oil pump according to the first embodiment.
Figure 3:
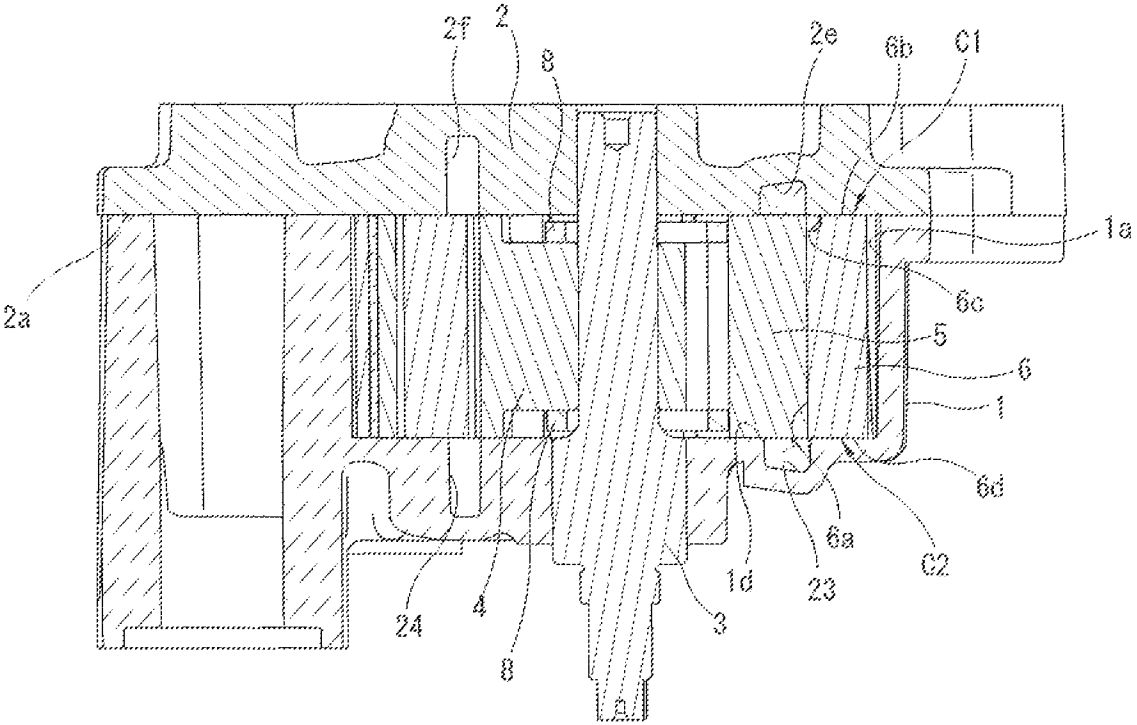
FIG. 3 is a sectional view which is taken along a line A-A of FIG. 2, and which shows the variable displacement oil pump according to the first embodiment.

FIG. 1 is an exploded perspective view showing the variable displacement oil pump according to the first embodiment, which is provided to a cylinder block (not shown) of an internal combustion engine, and so on. FIG. 2 is a front view showing the variable displacement oil pump according to the first embodiment, from which a cover member 2 is detached. Besides, an electromagnetic valve 13 is omitted in FIG. 2 for simplifying the drawing. FIG. 3 is a sectional view which is taken along a line A-A of FIG. 2, and which shows the variable displacement oil pump according to the first embodiment.

The variable displacement oil pump includes a housing including a housing main body 1 and a cover member 2; a drive shaft 3; a rotor 4; a plurality of (seven in this embodiment) vanes 5; a cam ring 6; a first coil spring 7; a pair of ring members 8; first to third seal means 9-11; five fixing means such as screw members 12, an electromagnetic valve 13, and a relief valve 14.

The housing main body 1 is integrally made of a metal material such as an aluminum alloy material. The housing main body 1 includes one end side which is opened, and which has a bottomed cylindrical shape having a pump receiving chamber 1*a* that is formed and recessed within the housing main body 1, and that has a substantially cylindrical shape. As shown in FIG. 1, the housing main body 1 includes a first bearing hole 1*c* which is formed at a central position of a bottom surface 1*b* of the pump receiving chamber 1*a*, and which is a drive shaft insertion hole rotatably supporting a first end of the drive shaft 3. The housing main body 1 includes a mounting surface 1*d* which is formed on an outer circumference side of the opening of the pump receiving chamber 1*a*, and which has a continuous annular flat shape. The mounting surface 1*d* of the housing main body 1 includes five screw holes 1*e* to which screw members 12 are screwed respectively.

The cover member 2 is made of a metal material such as an aluminum alloy material, similarly to the housing main body 1. The cover member 2 is used to close the opening of the housing main body 1. The cover member 2 has a flat plate shape. The cover member 2 has an outer profile corresponding to an outer profile of the housing main body 1. The cover member 2 includes a second bearing hole 2*a* which is formed at a position corresponding to the first bearing hole 1*c* of the housing main body 1, and which is the drive shaft insertion hole rotatably supporting a second end of the drive shaft 3. Moreover, the cover member 2 includes five fixing means through holes 2*b* (four fixing means through holes 2*b* are shown in FIG. 1) which are formed on the outer circumference portion of the cover member 2 at positions corresponding to the five screw holes 1*e* of the housing main body 1, to which the screw members 12 are inserted.

The housing main body 1 and the cover member 2 constitute a housing partitioning the pump receiving chamber 1*a*. This housing is not dipped (immersed) in an oil inside the internal combustion engine. That is, the housing is positioned above an oil level of the oil within an oil pan (not shown) provided to the internal combustion engine.

The drive shaft 3 penetrates through the central portion of the pump receiving chamber 1*a*. The drive shaft 3 is rotatably supported by the housing. The drive shaft 3 is rotationally driven by a crank shaft (not shown). The drive shaft 3 is configured to rotate the rotor 4 in a counterclockwise direction (rotation direction R) of FIG. 2 by a rotational force transmitted from the crank shaft.

The rotor 4 has a cylindrical shape. The rotor 4 is rotatably received within the pump receiving chamber 1*a*. A central portion of the rotor 3 is joined with the drive shaft 3. As shown FIG. 1 and FIG. 2, the rotor 4 includes seven slits 4*a* which are formed and opened to extend from an inner center side of the rotor 3 in radially outside directions. Moreover, as shown in FIG. 1 and FIG. 2, a back pressure chamber 4*b* is formed at an inner base end portion of each of the slits 4*a*. The back pressure chambers 4*b* are configured to introduce a discharge oil discharged to a discharge port 24 described later. As shown in FIG. 2, the back pressure chambers 4*b* are opened to circular recessed portions 4*c* formed on both side surfaces of the rotor 4. Each of the circular recessed portions 4*c* have a clearance between the rotor 4 and the bottom surface 1*b* of the pump receiving chamber 1*a*, and a clearance between the rotor 4 and an inner side surface 2*d* of the cover member 2. The oil from a second chamber 27 described later flows through the discharge port 24, an oil introduction groove (not show) formed on the bottom surface 1*b* of the pump receiving chamber 1*a*, and the circular recessed portions 4*c* into the back pressure chambers 4*b*. With this, the vanes 5 are pushed out in the outward direction by the centrifugal force according to the rotation of the rotor 4, and the hydraulic pressure of the back pressure chambers 4*b*. The vanes 5 are received within the slits 4*a* of the rotor 4 to be moved into and out of the slits 4*a*.

Each of the vanes 5 are formed of a metal into a thin plate shape. The vanes 5 are received within the slits 4*a* of the rotor 4 to be moved into and out of the slits 4*a*. In a state in which the vanes 4 are received within the slits 4*a*, a fine clearance is formed between each of the vanes 5, and one of the slits 4*a*. At the rotation of the rotor 4, tip end portions of the vanes 5 are slidably abutted on a cam profile surface 6*a* of the cam ring 6 which has a continuous circular shape. Inner end surfaces of base end portions of the vanes 5 are slidably abutted on an outer circumference surface of the ring member 8. With this, the vanes 5 are slidably abutted on the cam profile surface 6*a* of the cam ring 6 to liquid-tightly define the operation chambers 15 even when the engine speed is low so that the centrifugal force and the hydraulic pressures of the back pressure chambers 4*b* are small.

Moreover, the drive shaft 3, the rotor 4, and the vanes 5 constitute a pump constituting section. The cam ring 6 surrounding the pump constituting section is integrally formed of a sintered metal into a cylindrical shape. Furthermore, the cam ring 6 includes a first end surface 6*b* confronting the inner side surface 2*d* of the cover member 2. The first end surface 6*b* includes an inner circumference groove 6*c* which is adjacent to the cam profile surface 6*a*, and which has an arc shape extending along the cam profile surface 6*a*. As shown in FIG. 2, the inner circumference groove 6*c* has a circumferential length set to be larger than a range including three vanes 5 which are adjacent to one another in the rotation direction R of the rotor 4 in the suction region of the variable displacement oil pump. As shown in FIG. 3, a first side clearance C1 is formed between the first end surface 6*b* of the cam ring 6, and the inner side surface 2*d* of the cover member 2. The oil from the operation chambers 15 described later flow through the first side clearance C1. Similarly, as shown in FIG. 3, a second clearance C2 is formed between a second side surface 6*d* of the cam ring 6, and the bottom surface 1*b* of the pump receiving chamber 1*a*. The oil from the operation chamber 15 described later flows through the second clearance C2.

A first coil spring 7 is positioned on an outer circumference of the cam ring 6. The first coil spring 7 is received within the housing main body 1. The first coil spring 7 is configured to constantly urge the cam ring 6 in a direction in which an eccentric amount of the cam ring 6 with respect to the rotation center of the rotor 4 is increased. Moreover, the rotor 4 includes a circular recessed portion 4*c* in which the ring member 8 is slidably disposed.

First to third seal means 9-11 are mounted in the cam ring 6 to be slid on first to third seal abutment surfaces 1*g*, 1*h*, and 1*i*. The first to third seal means 9-11 partition a space between the cam ring 6 and the housing main body 1. With this, first and second chambers 26 and 27 (described later) which are control hydraulic chambers are liquid-tightly defined between the outer circumference surface of the cam ring 6 and the housing main body 1. The first seal means 9 include a first seal member 16; and a first elastic member 17 configured to urge the first seal member 16 toward the inner circumference surface of the housing main body 1. Furthermore, the second seal means 10 includes a second seal member 18; and a second elastic member 19 configured to urge the second seal member 18 toward the inner circumference surface of the housing main body 1. Moreover, the third seal means 11 includes a third seal member 20; and a third elastic member 21 configured to urge the third seal member 20 toward the inner circumference surface of the housing main body 1.

As shown in FIG. 1, a circular support hole 1*f* is formed at a position of the inner circumference wall of the pump receiving chamber 1*a*. The support hole 1*f* is configured to pivotally support the cam ring 6 through a cylindrical pivot pin 22. In FIG. 2, a "cam ring reference line M" is defined by a line passing through a center of the first bearing hole 1*c* (a rotation axis O1 of the pump constituting section), and a center of the support hole 1*f* (a center O2 of the pivot pin 22), for the following explanations.

As shown in FIG. 2, the first seal abutment surface 1*g* is formed on the inner circumference wall of the pump receiving chamber 1*a* in a first side region (a right side in FIG. 2) of the cam ring reference line M. The first seal member 16 provided on the outer circumference portion of the cam ring 6 is slidably abutted on the first seal abutment surface 1*g*. As shown in FIG. 2, the first seal abutment surface 1*g* is an arc surface having a predetermined radius R1 from the center O2 of the pivot pin 22. The radius R1 is set to a circumferential length by which the first seal member 16 can be constantly slidably abutted in an eccentric pivot range of the cam ring 6.

Similarly, as shown in FIG. 2, the second seal abutment surface 1*h* is formed on the inner circumference wall of the pump receiving chamber 1*a* in a second side region (a left side of FIG. 2) of the cam ring reference line M. The second seal member 18 provided on the outer circumference portion of the cam ring 6 is slidably abutted on this second seal abutment surface 1*h*. As shown in FIG. 2, the second seal abutment surface 1*h* is an arc surface having a predetermined radius R2 from the center O2 of the pivot pin 22. The radius R2 is smaller than the radius R1. The radius R2 is set to a circumferential length by which the second seal member 18 is constantly slidably abutted in the eccentric swing range of the cam ring 6.

Moreover, as shown in FIG. 2, the third seal abutment surface 1*i* is formed on the inner circumference wall of the pump receiving chamber 1*a* in the left side region of the cam ring reference line M at a position farther from the pivot pin 22 than the second seal abutment surface 1*h*. The third seal member 20 provided on the outer circumference portion of the cam ring 6 is slidably abutted on this third seal abutment surface 1*i*. As shown in FIG. 2, the third seal abutment surface 1*i* has an arc surface having a predetermined radius R3 from the center O2 of the pivot pin 22. The radius R3 is greater than the radius R1. The radius R3 is set to a circumferential length by which the third seal member 20 is constantly slidably abutted in the eccentric pivot region of the cam ring 6.

Furthermore, as shown in FIG. 2, a suction port 23 (shown in FIG. 2 by a solid line and a broken line) and a discharge port 24 are cut in the bottom surface 1*b* of the pump receiving chamber 1*a* in the outer circumference region of the drive shaft 3 to confront each other to sandwich the drive shaft 3. The suction port 23 is a suction opening portion which has an arc recessed shape. The discharge port 24 has a discharge opening portion which has a recessed arc shape similarly. The suction port 23 is formed on the bottom surface 1*b* of the pump receiving chamber 1*a* at a position opposite to the pivot pin 22. The suction port 23 is opened to the operation chambers 15 whose the volumes are increased in accordance with the rotation of the rotor 4, in the plurality of the operation chambers 15 in the direction of the rotation axis O1 of the rotor 4. Each of the operation chambers 15 is a space surrounded by adjacent two of the vanes 5, the outer circumference of the rotor 4, the cam profile surface 6*a* of the cam ring 6, the bottom surface 1*b* of the pump receiving chamber 1*a*, and the cover member 2. The suction port 23 includes a tapered termination end portion 23*a* formed at a terminal of the suction port 23 in the rotation direction R of the rotor 4. The terminal portion 23*a* is explained later.

Moreover, as shown in FIG. 3, the inner side surface 2*d* of the cover member 2 includes a suction groove 2*e* which is formed at a position corresponding to the suction port 23, and which has a shape substantially similar to the shape of the suction port 23. This suction groove 2*e* is connected to the suction hole 2*c* (cf. FIG. 1) provided to the cover member 2. With this, the oil stored in the oil pan (not shown) of the internal combustion engine is sucked to the operation chambers 15 (described later) in the suction region through the suction hole 2*c* and the suction groove 2*e* of the cover member 2 based on the negative pressure generated in accordance with the pump operation of the pump constituting section.

On the other hand, the discharge port 24 is positioned on the pivot pin 22 side. The discharge port 24 is opened to the region (the discharge region) in which the internal volume of the operation chamber 15 is decreased in accordance with the pump operation of the pump constituting section. As shown in FIG. 1, a discharge hole 1*j* is formed near an initiation end portion of the discharge port 24. The discharge hole 1*j* has a circular section. The discharge hole 1*j* penetrates through the side wall of the housing main body 1 to be opened to the outside. With this, the oil pressurized by the pump operation, and discharged to the discharge port 24 is supplied from the discharge hole 1*j* through the discharge passage (not shown) and the main gallery (not shown) to a valve timing device and the sliding portions (not shown) of the internal combustion engine, and so on. Besides, as shown in FIG. 3, the inner side surface 2*d* of the cover member 2 includes a discharge groove 2*f* which is formed at a position corresponding to the discharge port 24, and which has a shape identical to that of the discharge port 24.

Moreover, the housing main body 1 includes a spring receiving chamber 25 which is formed at a position to confront a flat portion 6*e* provided on the outer circumference of the cam ring 6 between the second seal member 18 and the third seal member 20. The spring receiving chamber 25 receives the first coil spring 7. The first coil spring 7 is elastically abutted on the first end wall of the spring receiving chamber 25 and the flat portion 6*e* within the spring receiving chamber 25. The first coil spring 7 is compressed by a predetermined set load W1. In this way, the first coil spring 7 is configured to constantly urge the cam ring 6 through the flat portion 6*e* by the elastic force based on the set load W1 in the direction (in the counterclockwise direction in FIG. 2) in which the eccentric amount is increased.

Figure 6:
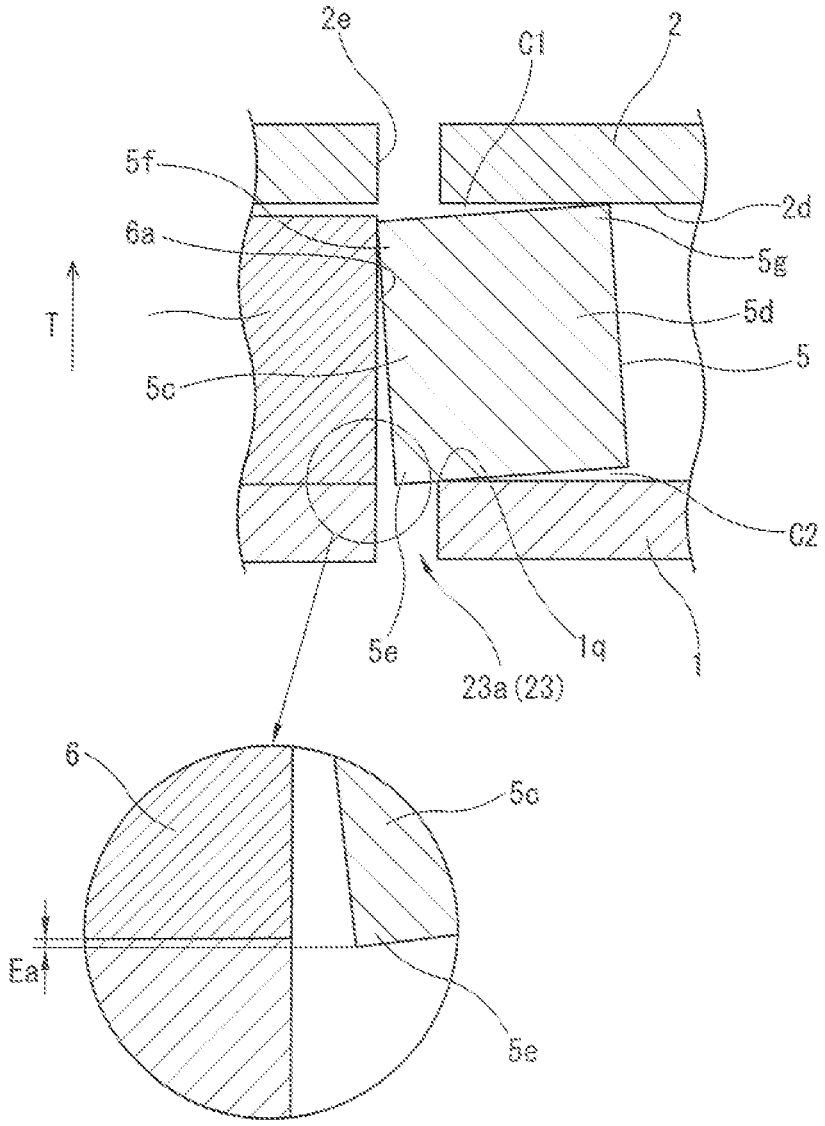
FIG. 6 is a schematically sectional view showing the housing, the vane, and the cam ring in the first embodiment, and showing a state in which the vane is fallen in a suction port.

Moreover, as shown in FIG. 6, the outer circumference portion of the cam ring 6 includes first to third seal holding portions 6*f*-6*h* which protrude at positions confronting the first to third seal abutment surfaces 1*g*-1*i*, and which have first to third seal surfaces. The first to third seal surfaces have predetermined radii slightly smaller than the radii R1, R2, and R3 of the corresponding seal abutment surfaces 1*g*, 1*h*, and 1*i* from the center O2 of the pivot pin 22. Fine clearances are formed between each of the seal surfaces, and one of the seal abutment surfaces 1*g*, 1*h*, and 1*i*. Moreover, the first and second seal holding grooves 6*i*, 6*j*, and 6*k* are formed, respectively, on the seal surfaces of the seal holding portions 6*f*, 6*g*, and 6*h* along the axial direction of the cam ring 6. The first and second seal holding grooves 6*i*, 6*j*, and 6*k* have the U-shaped section. The first to third seal members 16, 18, and 20 are held within the first to third seal holding grooves 6*i*-6*k*. The first to third seal members 16, 18, and 20 are abutted on the first to third seal abutment surfaces 1*g*, 1*h*, and 1*i* at the eccentric pivot of the cam ring 6.

Furthermore, the first chamber 26 is defined on the outer circumference region of the cam ring 6 by the first seal member 16 and an outer circumference portion of a substantially circular support wall portion 6*m* of the cam ring 6 surrounding the pivot pin 22. On the other hand, the second chamber 27 is defined by the second seal member 18 and the third seal member 20. The pump discharge pressure is introduced through the oil passages (not shown) to the first chamber 26. On the other hand, the pump discharge pressure is supplied through the oil passage (not shown) and the electromagnetic valve 13 to the second chamber 27. The first chamber 26 is configured to increase the volume thereof when the oil discharged from the discharge port 24 is introduced into the first chamber 26, and the cam ring 6 is moved in the direction in which the flow amount of the oil discharged from the discharge port 24 is decreased. Moreover, the second chamber 27 is a space including the spring receiving chamber 25. The second chamber 27 is configured to increase the volume thereof when the cam ring 6 is moved in the direction in which the flow amount of the oil discharged from the discharge port 24 is increased.

A surface of the outer circumference surface of the cam ring 6 which is adjacent to the first chamber 26 is a first pressure receiving surface 6*n* configured to receive the pump discharge pressure introduced to the first chamber 26. Moreover, a surface of the outer circumference surface of the cam ring 6 which is adjacent to the second chamber 27 is a second pressure receiving surface 60 (including the flat portion 6*e*) configured to receive the pump discharge pressure introduced into the second chamber 27.

The pump discharge pressures are acted to the corresponding first and second pressure receiving surfaces 6*n* and 60 of the cam ring 6 to control the eccentric amount of the cam ring 6 by the balance between the urging force based on the hydraulic pressure acted to the first and second pressure receiving surfaces 6*n* and 60, and the urging force by the first coil spring 7. In this case, the pressure receiving area of the first pressure receiving surface 6*n* is set to be greater than the pressure receiving area of the second pressure receiving area 60. In a case in which the hydraulic pressure is acted to the both pressure receiving surfaces 6*n* and 60, the cam ring 6 is urged in the direction in which the eccentric amount is decreased.

The electromagnetic valve 13 includes a valve portion 28 configured to serve for the discharge and the supply of the oil in accordance with an axial position in a movement direction of a spool (not shown); and a solenoid portion 29 configured to control the axial position of the spool by the energization. As shown in FIG. 1, the electromagnetic valve 13 is provided to a block portion 1*k* which is integrally formed on the back surface of the housing main body 1, and which has a regular hexahedron shape. More specifically, the valve portion 28 positioned at the tip end side of the electromagnetic valve 13 is received within a control valve receiving portion 30 recessed with respect to a surface 1*m* of the block portion 1*k* as shown in FIG. 1. The solenoid portion 29 positioned on the rear end side of the electromagnetic valve 13 protrudes from the surface 1*m* of the block portion 1*k* to the outside.

The relief valve 14 is received within a valve receiving hole (not shown) formed in the housing main body 1 near the discharge port 24. The relief valve 14 is configured to be opened to escape the discharge pressure to the outside when the discharge pressure of the variable displacement oil pump is higher than a predetermined discharge pressure. The relief valve 14 includes a cover 31 closing the valve receiving hole; a spring 32 including a first end abutted on the cover 31; and a ball 33 on which a second end of the spring 32 is abutted. When the discharge pressure of the variable displacement oil pump is higher than the predetermined discharge pressure, the discharge pressure is acted to the ball 33. The ball 33 compresses the spring 32 with respect to the cover 31 so as to escape the discharge pressure through a relief hole (not shown) provided on the back surface side of the ball 33 to the outside.

Figure 4:
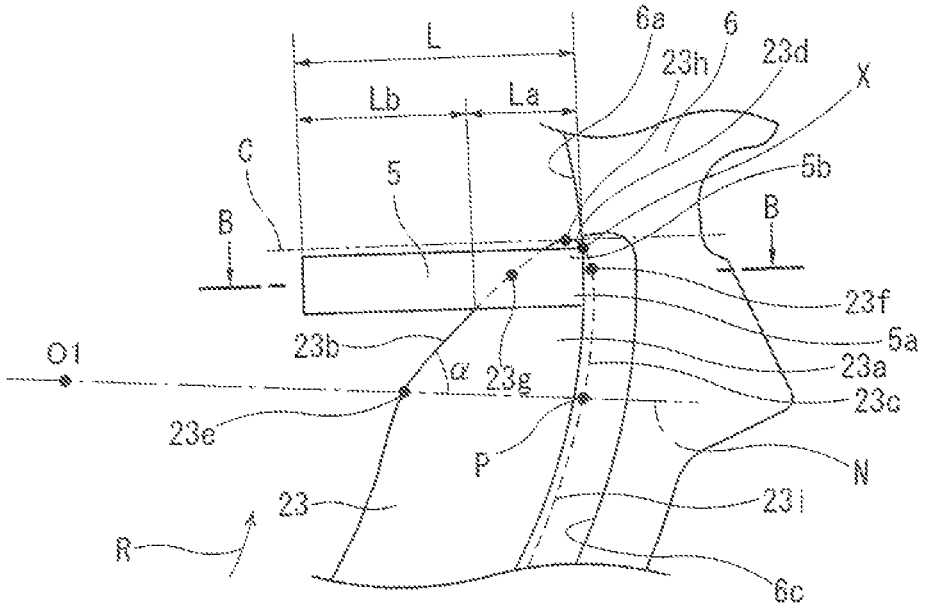
FIG. 4 is a partially enlarged plan view showing the variable displacement oil pump according to the first embodiment.
Figure 5:
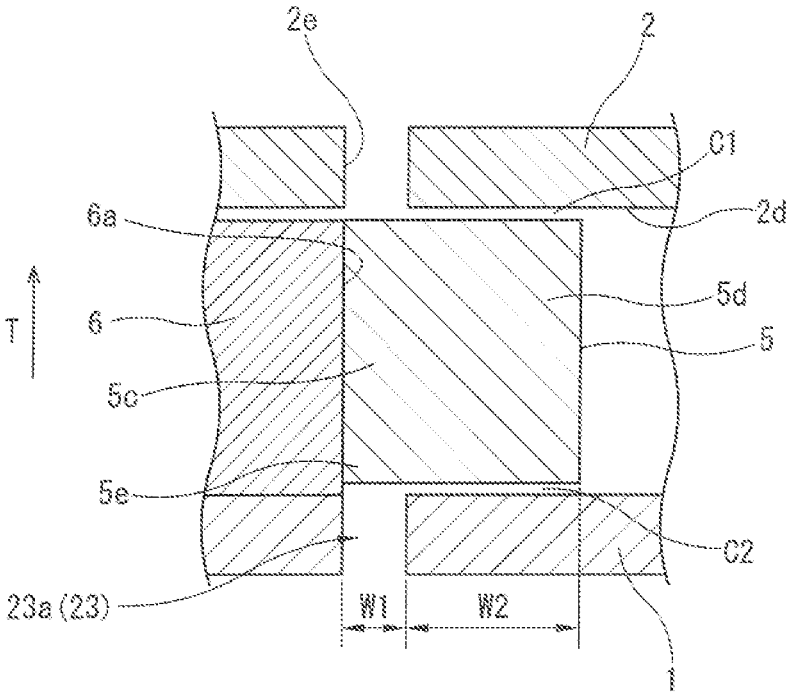
FIG. 5 is a schematically sectional view which is taken along a line B-B of FIG. 4, and which shows a housing, a vane, and a cam ring in the first embodiment.

FIG. 4 is a partially enlarged plan view showing the variable displacement oil pump according to the first embodiment when one of the vanes 5 passes through the termination end portion 23*a* of the suction port 23 in a state in which the cam ring 6 is in the maximum eccentric state (cf. FIG. 2). Besides, the rotor 4 and the ring member 8 are omitted in FIG. 4 for the explanation. FIG. 5 is a schematically sectional view which is taken along a line B-B of FIG. 4, and which shows the housing, the vane 5, and the cam ring 6 in the first embodiment. FIG. 6 is a schematically sectional view showing the housing, the vane 5, and the cam ring 6 in the first embodiment in the state in which the vane 5 is fallen in the suction port 23. Besides, for the explanation, FIG. 5 and FIG. 6 show the sectional view in the state in which the cover member 2 is mounted. In FIG. 5 and FIG. 6, the bottom portion of the suction port 23, the bottom portion of the suction groove 2*e*, and the inner circumference groove 6*c* are omitted.

The termination end portion 23*a* of the suction port 23 includes a termination end inner circumference portion (shown by a solid line and a broken line in FIG. 4); a termination end outer circumference portion (shown by a broken line in FIG. 4) 23*c* positioned outside the termination end inner circumference portion 23*b*; and a curved surface portion 23*d* (shown by a solid line and a broken line in FIG. 4) connecting the termination end inner circumference portion 23*b* and the termination end outer circumference portion 23*c*.

The termination end inner circumference portion 23*b* is positioned inside the cam profile surface 6*a* of the cam ring 6. The termination end inner circumference portion 23*b* is provided so that the inner circumference of the suction port 23 becomes larger in the radially outside direction of the rotor 4 as the suction portion 23 progresses in the rotation direction R of the rotor 4. More specifically, in the termination end inner circumference portion 23*b*, the inner circumference of the suction port 23 is linearly inclined in the radially outside direction of the rotor 4 so that an angle $\alpha$ which is an inferior angle formed by the termination end inner circumference portion 23*b* and a line N passing through the rotation axis O1 of the pump constituting section, and one end 23*e* of the termination end inner circumference portion 23*b* has a predetermined angle, substantially 50 degrees in this embodiment.

The termination end outer circumference portion 23*c* is positioned outside the cam profile surface 6*a* of the cam ring 6. More specifically, as shown in FIG. 4, the termination end outer circumference portion 23*c* is disposed near the cam profile surface 6*a* in an overlap region with the inner circumference groove 6*c* of the cam ring 6 when viewed in the direction along the rotation axis O1 of the pump constituting section. The termination end outer circumference portion 23*c* extends in the arc shape in parallel with the cam profile surface 6*a* from a cross point P between the termination end portion 23*c* and the line N to one end 23*f* of the curved surface portion 23*d* along the rotation direction R of the rotor 4. That is, the termination end outer circumference portion 23*c* extends in the curved shape at the one end 23*f* of the curved surface portion 23*d* in substantially parallel with the cam profile surface 6*a* having the arc shape. Moreover, the termination end outer circumference portion 23*c* is smoothly connected through the cross point P to the port outer circumference portion 23*i* of the suction port 23 which is positioned outside the cam profile surface 6*a*, and which extends in the arc shape in parallel with the cam profile surface 6*a*.

The curved surface portion 23*d* is provided at an outermost end of the suction port 23 in the rotation direction R of the rotor 4. The curved surface portion 23*d* extends in the curved shape from the first end 23*f* to the second end 23*g* to expand on the rotation direction R side. The curved surface portion 23*d* extends from the outside of the cam profile surface 6*a* to the inside of the cam profile surface 6*a* to cross with the cam profile surface 6*a* at a cross point X. As shown in FIG. 4, in the cross point X, a most portion of the curved surface portion 23*d* is disposed inside the cross portion X, that is, inside the cam profile surface 6*a*. On the other hand, a residual portion of the curved surface portion 23*d* is disposed outside the cross portion X, that is, outside the cam profile surface 6*a*. As shown in FIG. 4, by this cross portion X, when the corner portion 5*a* on the rotation direction R side of the rotor 4 in the two corner portions 5*a* and 5*b* on the radially outer side of the vane 5 comes to place the cross portion X, a radial length La of the vane 5 confronting the suction port 23 is shorter than a half of the entire length L of the vane 5. Conversely, a radial length Lb of the vane 5 which does not confront the suction port 23 is longer than the half of the entire length L of the vane 5.

Moreover, the curved surface portion 23*d* includes a termination end portion 23*h* which is disposed slightly inside the cross portion X, and which is positioned at a terminal of the curved surface portion 23*d* in the rotation direction R of the rotor 4. A tangent line C (shown by an imaginary line in FIG. 4) passing through the termination end portion 23*h* is provided in the radial direction of the rotor 4, that is, in a direction in which the vane 5 is moved into and out of the outer circumference side of the rotor 4.

Accordingly, as shown in FIG. 5, a first portion 5*c* of the vane 5 which is adjacent to the cam ring 6 is overlapped with the termination end portion 23*a* of the suction port 23 which has a narrow width (a width in the leftward and rightward directions of FIG. 5) in a thickness direction T (a direction along the rotation axis O1) of the cam ring 6. On the other hand, a second portion 5*d* which is a residual portion of the vane 5 is overlapped with the housing main body 1 and the cover member 2 in the thickness direction of the cam ring 6 by a width W2 wider than the width W1. Accordingly, when the width of the first side clearance C1 becomes narrower than the width of the second side clearance C2 due to the outside input, and so on, in a case in which the relatively high hydraulic pressure of the first clearance C1 pushes the vane toward the second side clearance C2 side, as shown in FIG. 6, the edge portion 5*e* of the vane 5 is fallen in the termination end portion 23*a* about the edge portion 1*q* of the termination end portion 23*a*, a caught amount (engaging amount) Ea of the vane 5 becomes small. In this case, the caught amount Ea is a length along the thickness direction T of the cam ring 6 at the edge portion 5*e* of the vane 5 within the suction port 23. Moreover, in a state in which the edge portion 5*e* is fallen within the termination end portion 23*a*, an edge portion 5*f* on the opposite side with respect to the edge portion 5*e* of the vane 5 in the thickness direction of the cam ring 6 is abutted on the cam profile surface 6*a* of the cam ring 6. Simultaneously, an edge portion 5*g* on the opposite side with respect to the edge portion 5*f* of the vane 5 in the radial direction of the vane 5 is abutted on the inner side surface 2*d* of the cover member 2.

Effects of First Embodiment

Figure 7:
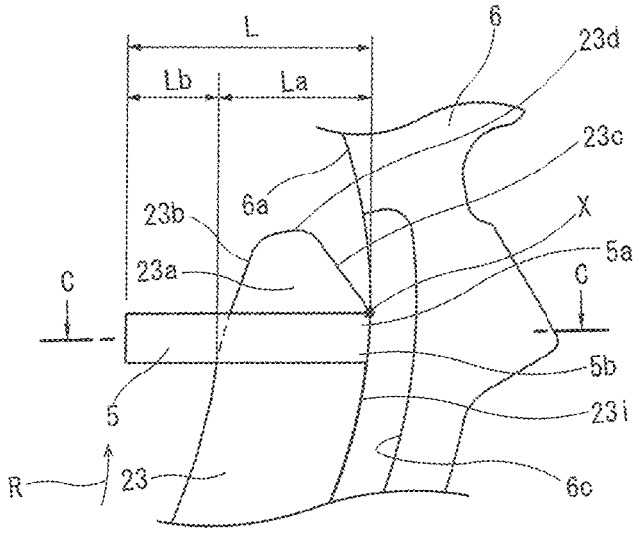
FIG. 7 is a partially enlarged view showing a variable displacement oil pump of a conventional art.
Figure 8:
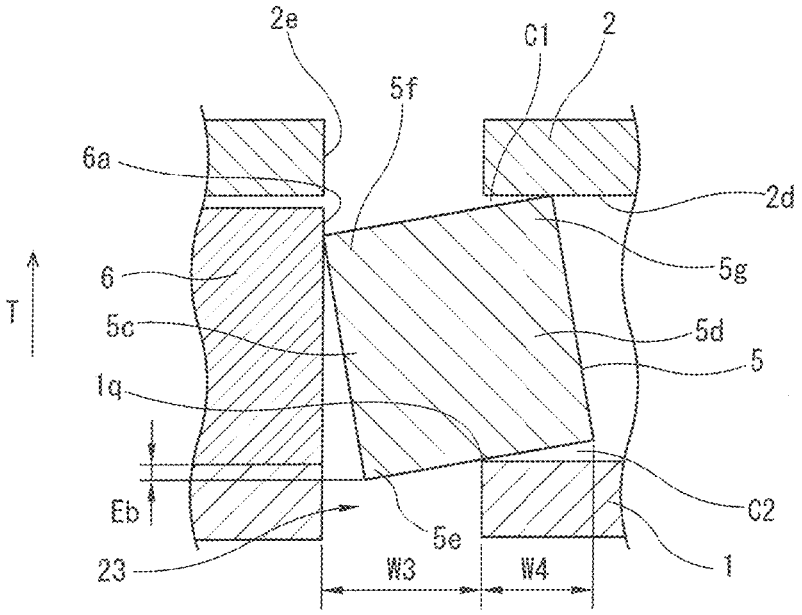
FIG. 8 is a schematically sectional view showing the housing, the vane, and the cam ring in the conventional art, and showing a state in which the vane is fallen in the suction port.

FIG. 7 is a partially enlarged plan view showing a variable displacement oil pump of a conventional art when one of the vanes 5 passes through the termination end portion 23*a* of the suction port 23 in a state in which the cam ring 6 is in the maximum eccentric state. Besides, in FIG. 7, the rotor and the ring member are omitted for the explanation. FIG. 8 is a schematically sectional view showing the housing, the vane 5, and the cam ring 6 in the conventional art, and showing a state in which the vane 5 is fallen in the suction port 23. For the explanation, FIG. 8 shows the sectional view in which the cover member 2 is mounted. In FIG. 8, the bottom portion of the suction port 23, the bottom portion of the suction groove 2*e*, and the inner circumference groove 6*c* are omitted.

As shown in FIG. 7, in the termination end portion 23*a* of the suction port 23 of the conventional art, the curved surface portion 23*d* is positioned inside the cam profile surface 6*a* of the cam ring 6. One end of the termination end outer circumference portion 23*c* is overlapped with the cam profile surface 6*a* at the cross portion X in the thickness direction of the cam ring 6. As shown in FIG. 7, the corner portion 5*a* on the rotation direction of the rotor 4 in the two corner portions 5*a* and 5*b* on the radially outer side of one of the vanes 5 comes to place the cross portion X, the radial length La of the vane 5 confronting the termination end portion 23*a* becomes longer than the half of the entire length L of the vane 5. Conversely, the radial length Lb of the vane 5 which does not confront the suction port 23 becomes shorter than the half of the entire length L of the vane 5.

Accordingly, as shown in FIG. 8, the first portion 5*c* of the vane 5 which is adjacent to the cam ring 6 is overlapped with the suction port 23 having a width W3 wider than that of the first embodiment (cf. FIG. 6) in the thickness direction T of the cam ring 6. On the other hand, the second portion 5*d* of the vane 5 is overlapped with the housing main body 1 and the cover member 2 in the thickness direction T of the cam ring 6 by a width W4 narrower than the width W2 in the first embodiment. Accordingly, as shown in FIG. 8, when the edge portion 5*e* of the vane 5 is fallen within the termination end portion 23*a* about (around) the edge portion 1*q* of the suction port 23 due to the pressure difference between the first and second side clearances C1 and C2, a caught amount Eb of the vane 5 becomes larger than that of the first embedment (cf. FIG. 6). With this, the edge portion 5*f* on the opposite side with respect to the edge portion 5*e* of the vane 5 in the thickness direction T of the cam ring 6 is tightly abutted on the cam profile surface 6*a* of the cam ring 6. Simultaneously, the edge portion 5*g* on the opposite side with respect to the edge portion 5*f* of the vane 5 in the radial direction of the vane 5 is tightly abutted on the inner side surface 2*d* of the cover member 2. Accordingly, there is problem that the noise is generated due to the abutment between the vane 5 and the cam ring 6, and the abutment between the vane 5 and the cover member 2.

On the other hand, in the first embodiment, the termination end portion 23*a* of the suction port 23 includes the termination end inner circumference portion 23*b*; the termination end outer circumference portion 23*c* positioned radially outside the cam profile surface 6*a* of the cam ring 6; and the curved surface 23*d* connecting the termination end inner circumference portion 23*b* and the termination end outer circumference portion 23*c*. At the cross point X at which the curved surface portion 23*c* crosses the cam profile surface 6*a*, the radial length La of the vane 5 confronting the suction port 23 becomes shorter than the half of the entire length L of the vane 5. Accordingly, when the edge portion 5*e* of the vane 5 is fallen in the suction port 23 about (around) the edge portion 1*q* of the suction port 23, for example, due to the hydraulic pressure difference between the first and second side clearances C1 and C2, the caught amount Ea of the vane 5 becomes small. Conversely, when the edge portion 5*a* of the vane 5 is fallen within the suction port 23, the long region corresponding to the radial length Lb of the vane 5 which does not confront the suction port 23 is held by the housing main body 1 and the cover member 2. With this, the edge portion 5*f* of the vane 5 is relatively loosely abutted on the cam profile surface 6*a* of the cam ring 6, and the edge portion 5*g* of the vane 5 is relatively loosely abutted on the inner side surface 2*d* of the cover member 2, relative to the oil pump of the conventional art. Accordingly, it is possible to suppress the noise generated due to the abutment between the vane 5 and the cam ring 6, and the abutment between the vane 5 and the cover member 2.

Moreover, in the first embodiment, the oil pump includes the cam ring 6 including the cam profile surface 6*a*; and the first chamber 26 provided between the cam ring 6 and the circumference wall of the pump receiving chamber 1*a*. The termination end outer circumference portion 23*c* extends in the arc shape in parallel to the cam profile surface 6*a*. Accordingly, the shape of the termination end outer circumference portion 23*c* is determined based on the cam profile surface 6*a* of the existing cam ring 6. Therefore, it is possible to readily design the shape of the termination end portion 23*a* of the suction port 23.

Moreover, in the first embodiment, the cam ring 6 includes the inner circumference groove 6*c* which is formed on the first end surface of the cam ring 6, and which is adjacent to the cam profile surface 6*a*. The termination end outer circumference portion 23*c* is provided near the cam profile surface 6*a* (on the cam profile surface 6*a* side) in the overlapping region with the inner circumference groove 6*c* when viewed in the direction of the rotation axis O1 of the rotor 4. Accordingly, relative to a case in which the termination end outer circumference portion 23*c* is not provided near the cam profile surface 6*a*, it is possible to ensure the large width of the cam ring 6 adjacent to the first chamber 26, that is, the large seal width for the first chamber 26, and to effectively control the cam ring 6 by the oil within the first chamber 26.

Moreover, in the first embodiment, the termination end portion 23*a* further includes the curved surface portion 23*d* which is positioned at the terminal of the suction port 23, and which passes through the cross portion X. The tangent line C passing through the termination end portion 23*h* of the curved surface portion 23*d* in the rotation direction R is provided along the direction in which the vanes 5 are moved into and out of the outer circumference side of the rotor 4. By the thus-provided termination end portion 23*h*, relative to a case in which the outermost end side of the termination end portion is formed into the flat shape, it is possible to maximize the volume of the suction port 23, and to maximally improve the suction efficiency of the variable displacement oil pump.

Furthermore, in a case in which the vane 5 is moved into and out to be further inclined relative to the radial direction with respect to the rotation axis O1 of the rotor 4, the length of the vane 5 confronting the suction port 23 becomes long, relative to a case in which the vane 5 is moved into and out in the radial direction. Consequently, the edge portion 5*e* of the vane 5 is easy to be fallen in the suction port 23. However, in the first embodiment, the vane 5 are moved into and out in the radial direction with respect to the rotation axis O1 of the rotor 4. Accordingly, the radial length La of the vane 5 confronting the suction port 23 is shorter than the case in which the vane 5 is moved into and out to be further inclined relative to the radial direction. With this, the edge portion 5*e* of the vane 5 is difficult to be fallen in the suction port 23. Therefore, it is possible to suppress the noise generated due to the abutment between the vanes 5 and the cam ring 6, and the abutment between the vanes 5 and the cover member 2.

Moreover, in the first embodiment, the pump constituting section is received within the circular recessed portion 4*c*. The pump constituting section further includes the annular ring member 8 configured to urge the plurality of the vanes 5. Accordingly, even when the rotation speed of the rotor 4 is small, the ring member 8 pushes the vanes 5 toward the cam profile surface 6*a* of the cam ring 6. With this, the vanes 5 are held between the outer circumference surface of the ring member 8, and the cam profile surface 6*a*. Consequently, the edge portions 5*e* of the vanes 5 are difficult to be fallen in the suction port 23. Therefore, it is possible to suppress the noise generated by the abutment between the vanes 5 and the cam ring 6, and the abutment between the vanes 5 and the cover member 2.

Furthermore, in the first embodiment, the housing constituting the pump constituting section is not dipped (immersed) in the oil within the oil pan provided to the internal combustion engine, so that the noise is easy to be generated. However, by the configuration having the termination end outer circumference portion 23*c* positioned radially outside the cam profile surface 6*a*, it is possible to suppress the noise.

Second Embodiment

Figure 9:
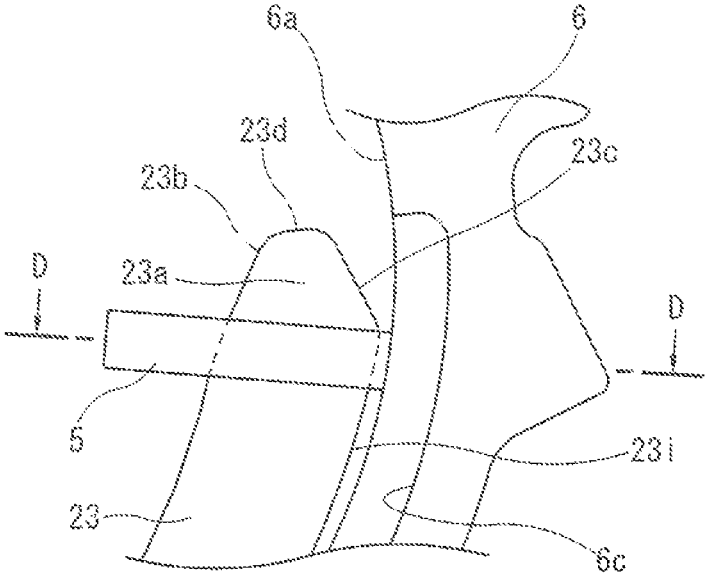
FIG. 9 is a partially enlarged plan view showing a variable displacement oil pump according to a second embodiment.
Figure 10:
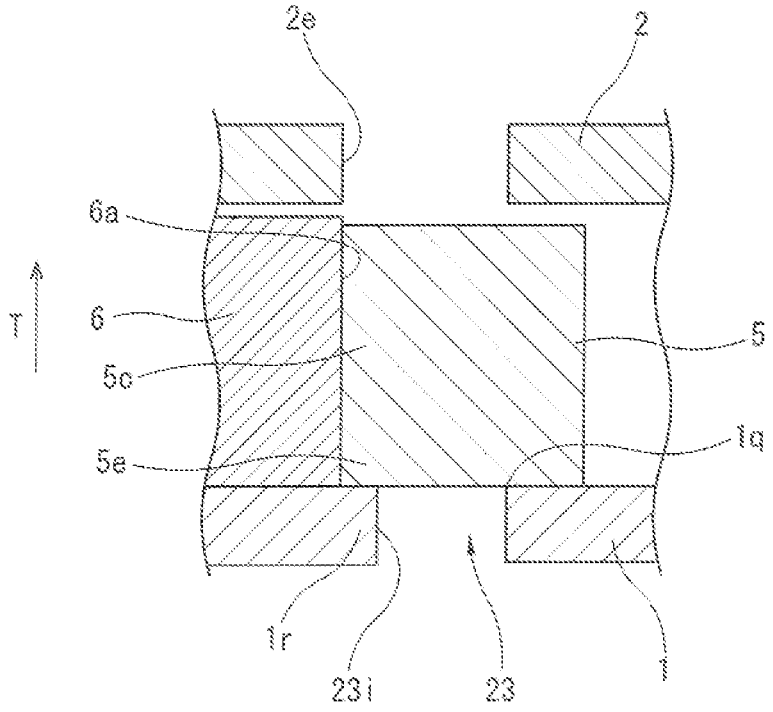
FIG. 10 is a schematically sectional view showing the housing, the vane, and the cam ring in the second embodiment.

FIG. 9 is a partially enlarged plan view showing a variable displacement oil pump according to a second embodiment. Besides, the rotor 4 and the ring member 8 are omitted in FIG. 9 for the explanation. FIG. 10 is a schematically sectional view showing a housing, vanes 5, and a cam ring 6 in the second embodiment. Besides, FIG. 10 shows the sectional view in which the cover member 2 is mounted for the explanation. A bottom portion of a suction port 23, a bottom portion of a suction groove 2, and an inner circumference groove 6*c* are omitted in FIG. 10.

As shown in FIG. 9, in the second embodiment, a termination end outer circumference portion 23*c* of the termination end portion 23*a*, and a port outer circumference portion 23*i* of the suction port 23 connected to the termination end outer circumference portion 23*c* are provided inside the cam profile surface 6*a* of the cam ring 6. Accordingly, as shown in FIG. 10, the port outer circumference portion 23*i* of the suction port 23 is provided inside the cam profile surface 6*a* of the cam ring 6. That is, a portion 1*r* of the housing main body 1 which is adjacent to the port outer circumference portion 23*i* protrudes toward the radially inward side relative to the cam profile surface 6*a*. When the vane 5 comes to place the termination end outer circumference portion 23*c* as shown in FIG. 9, the vane 5 is disposed so as to bridge (override) the suction port 23 as shown in FIG. 10. That is, when the vane 5 comes to place the termination end outer circumference portion 23*c*, the edge portion 5*e* of the first portion 5*c* of the vane 5 is mounted on the portion 1*r* of the housing main body 1. On the other hand, the second portion 5*d* of the vane 5 is mounted on the portion of the housing main body 1 including the edge portion 1*q*.

Effects of Second Embodiment

In the second embodiment, the termination end portion 23*a* of the suction port 23 includes the termination end inner circumference portion 23*b*; the termination end outer circumference portion 23*c* provided outside the termination end inner circumference portion 23*b*, and positioned radially inside the cam profile surface 6*a*; and the port outer circumference portion 23*i* connected with this termination end outer circumference portion 23*c*, and positioned radially inside the inner circumference of the cam profile surface 6*a*. Accordingly, the portion 1*r* of the housing main body 1 protrudes on the radially inner side relative to the cam profile surface 6*a*. The edge portion 5*e* of the vane 5 is supported by the portion 1*r* of the housing main body 1. Accordingly, it is possible to suppress the falling of the edge portion 5*a* into the suction port 23. Therefore, it is possible to suppress the generation of the noise due to the abutment between the vanes 5 and the cam ring 6, and the abutment between the vanes 5 and the housing main body 1.

Besides, the above-described embodiment exemplify the examples of the oil pump in which the oil is used as the working fluid. However, the present invention is applicable to a pump in which a water, and so on is used as the working fluid.

Moreover, the above-described embodiments exemplify the examples of the variable displacement oil pump. However, the present invention is applicable to a fixed displacement oil pump.

The invention claimed is:

1. An oil pump comprising:

a housing including a pump receiving chamber;

a pump constituting section including a cam profile surface provided within the pump receiving chamber, a rotor received radially inside the cam profile surface, and a plurality of vanes which are provided on an outer circumference side to be moved into and out of the rotor, and which form a plurality of operation chambers between the cam profile surface and an outer circumference of the rotor;

a discharge opening portion formed in the pump receiving chamber, and opened to operation chambers of the plurality of the operation chambers in which volumes are decreased in accordance with a rotation of the rotor, in a direction of a rotation axis of the rotor; and a suction opening portion which is formed in the pump receiving chamber, which is opened to operation chambers of the plurality of the operation chambers in which volumes are increased in accordance with the rotation of the rotor in the direction of the rotation axis of the rotor, and which includes a termination end portion of the suction opening portion in the rotation direction of the rotor, the termination end portion including a termination end inner circumference portion, a termination end outer circumference portion provided radially outside the termination end inner circumference portion, and positioned radially outside the cam profile surface, a curved surface portion connecting the termination end inner circumference portion and the termination end outer circumference portion, and a cross portion at which the curved surface portion is crossed with the cam profile surface, and which is positioned at a position at which a radial length of a vane of the plurality of the vanes that confronts the suction opening portion is shorter than a half of an entire length of the vane, wherein the pump constituting section further includes a cam ring configured to be moved within the pump receiving chamber, wherein the cam profile surface is formed on an inner circumference surface of the cam ring, the rotor and the vanes are provided to the inner circumference surface of the cam ring, and the termination end outer circumference portion extends in an arc shape in parallel to the cam profile surface.

2. The oil pump as claimed in claim 1, wherein the cam ring includes an inner circumference groove which is formed on a side surface of the cam ring, and which is adjacent to the cam profile surface; and the termination end outer circumference portion is provided near the cam profile surface in an overlapping region with the inner circumference groove when viewed from the direction of the rotation axis of the rotor.

3. The oil pump as claimed in claim 1, wherein a tangent line passing through a termination end portion of the curved surface portion in the rotation direction extends in a direction in which the plurality of vanes are moved into and out of the outer circumference side of rotor.

4. The oil pump as claimed in claim 3, wherein the plurality of vanes are configured to be moved into and out in radial directions with respect to the rotation axis of the rotor.

5. The oil pump as claimed in claim 1, wherein the rotor includes;

a plurality of slits each of which extends from an inner central side in the radial direction in the radially outside direction, in which the plurality of vanes are received respectively, an outer circumference portion which is provided on the outer circumference side of the rotor, and which is configured to be slid on the pump receiving chamber, a recessed portion which is provided radially inside the outer circumference side of the rotor, and which forms a clearance between the recessed portion and the pump receiving chamber, and a drive shaft insertion hole which is opened to the recessed portion, and to which a drive shaft configured to rotate the rotor is inserted;

the pump constituting section further comprises an annular ring member received within the recessed portion, and configured to urge the plurality of the vanes.

6. The oil pump as claimed in claim 1, wherein the housing is not dipped in an oil inside an internal combustion engine.

* * * * *